United States Patent [19]

Hendricks

[11] Patent Number: 4,898,516

[45] Date of Patent: Feb. 6, 1990

[54] PROTECTIVE FAN SHIELD

[76] Inventor: Debra S. Hendricks, 666 E. Findlay St., Carey, Ohio 43316

[21] Appl. No.: 310,945

[22] Filed: Feb. 16, 1989

[51] Int. Cl.[4] ..... B63H 1/00

[52] U.S. Cl. ..... 416/247 R

[58] Field of Search ..... 55/385.1, 385.2, 385.7, 55/471, 474; 416/247 R

[56] References Cited

U.S. PATENT DOCUMENTS

| | | | |
|---|---|---|---|
| 2,036,478 | 4/1936 | Hopf et al. | 416/247 |
| 2,812,900 | 11/1957 | Matthews | 416/247 |
| 2,923,463 | 2/1960 | Shunkwiler | 416/247 |
| 3,262,638 | 7/1966 | Militello | 416/247 |

*Primary Examiner*—Harold Joyce
*Attorney, Agent, or Firm*—Leon Gilden

[57] ABSTRACT

A protective fan shield for securement about an associated rotating blade fan. The shield is formed of open mesh fiberglass netting with a resilient continuous elastomeric band at a terminal end for securement of the shield about the associated fan. The shield is further formed with pockets formed within the surface of the shield and directed orthogonally relative to the ribs defining the protective cage of the fan. The pockets enable securement of flexible strut for maintaining the shield from entering between the support ribs of the associated fan.

1 Claim, 1 Drawing Sheet

PROTECTIVE FAN SHIELD

BACKGROUND OF THE INVENTION

1. Field of the Invention

The field of invention relates to fan organizations, and more particularly pertains to a new and improved protective fan shield in securement about an associated fan preventing infants and the like from projecting their fingers and limbs between the support ribs of the cage utilized about rotating fan blades.

2. Description of the Prior Art

The use of protective guards about associated fans is known in the prior art. Heretofore, however, the guards have generally been of an open-cage configuration enabling infants to project portions of their anatomy, such as fingers, between the spaced ribs of an associated cage. Further, the prior art has not heretofore provided for a basis of selectively removing a protective flexible shield securable about an associated fan during periods that infants and toddlers are not present in the surrounding area about a fan. For example, U.S. design patent 174,930 to Tateishi, U.S. design patent 153,542 to Owens, et al., U.S. design patent 129,488 to Norris, U.S. design patent 104,119 to Schwarz, and U.S. design patent 291,486 to Kouno, et al. are all illustrative of typical rotating fan blade cage constructions, but do not provide the removable protective shield that may be selectively securable about an associated fan, as set forth by the instant invention.

As such, it may be appreciated that there is a continuing need for a new and improved protective fan shield which addresses both the problems of ease of use and effectiveness in use, and in this respect the present invention substantially fulfills this need.

SUMMARY OF THE INVENTION

In view of the foregoing disadvantages inherent in the known types of protective fan guard devices now present in the prior art, the present invention provides a protective fan shield wherein the same may be compactly stored when not in use and may be further easily and efficiently secured to an associated fan during periods of use. As such, the general purpose of the present invention, which will be described subsequently in greater detail, is to provide a new and improved protective fan shield which has all the advantages of the prior art fan guard devices and none of the disadvantages.

To attain this, the present invention comprises an open-mesh flexible fiberglass webbing formed with a perimeter elastomeric securement band captured within the conduit of the webbing. A plurality of flexible struts are removably positioned within pockets of the shield formed on the outer surface of the shield to prevent the webbing from entering between the ribs of an associated protective cage about a rotating fan.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matte of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective fan shield which has all the advantages of the prior art protective fan shields and none of the disadvantages.

It is another object of the present invention to provide a new and improved protective fan shield which may be easily and efficiently manufactured and marketed.

It is a further object of the present invention to provide a new and improved protective fan shield which is of a durable and reliable construction.

An even further object of the present invention is to provide a new and improved protective fan shield which is susceptible of a low cost of manufacture with regard to both materials and labor, and which accordingly is then susceptible of low prices of sale to the consuming public, thereby making such protective fan shield economically available to the buying public.

Still yet another object of the present invention is to provide a new and improved protective fan shield which provides in the apparatuses and methods of the prior art some of the advantages thereof, while simultaneously overcoming some of the disadvantages normally associated therewith.

Still another object of the present invention is to provide a new and improved protective fan shield wherein the same may be readily secured about an associated fan preventing infants and the like from directing their fingers therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
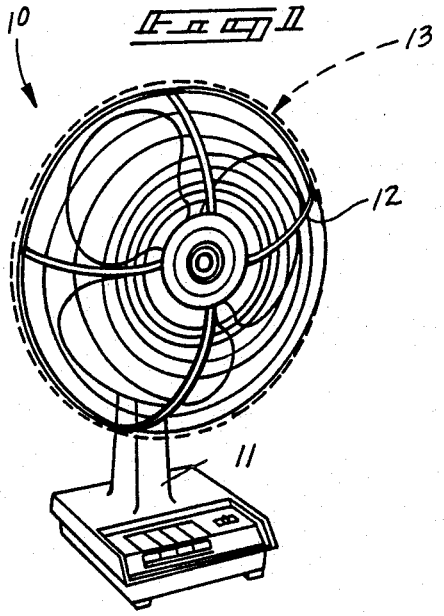
FIG. 1 is an isometric illustration of the instant invention.
Figure 2:
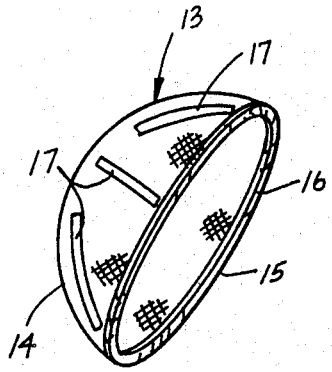
FIG. 2 is an isometric illustration of the instant invention removed from an associated fan.
Figure 3:
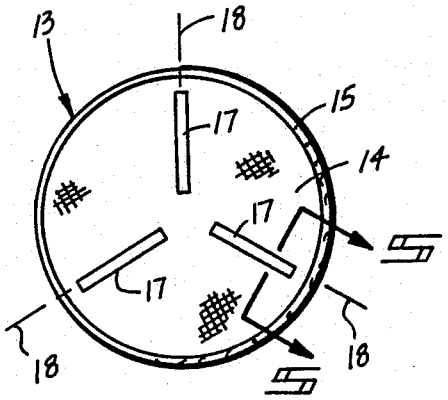
FIG. 3 is an orthographic top view of the fan shield as set forth in FIG. 2.

With reference now to the drawings, and in particular to FIGS. 1 to 5 thereof, a new and improved protective fan shield embodying the principles and concepts of the present invention and generally designated by the reference numeral 10 will be described.

More specifically, it will be noted that the protective fan shield apparatus 10 essentially comprises a rotating blade fan 11 formed with an arcuate cage 12 including a series of circular concentrically formed ribs defining the cage. The shield 13 is formed of a woven fiberglass net 14 with a desired optimum mesh size of 17 squares per inch. A perimeter conduit 15 is formed within the outer terminal edge of the hemispherical shield 13 capturing a continuous elastomeric band 16 therewithin for securement about the associated fan 11.

Figure 4:
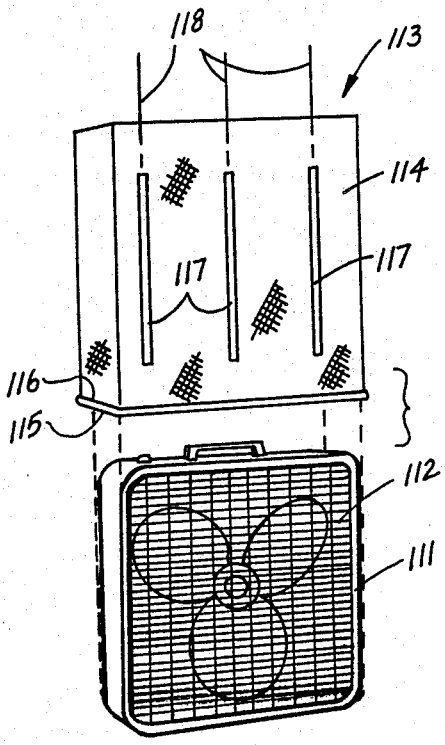
FIG. 4 is an isometric illustration of a modification of the fan shield for securement about a polygonal fan.
Figure 5:
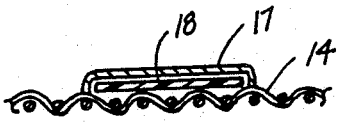
FIG. 5 is an orthographic view taken along the lines 5—5 of FIG. 3 in the direction indicated by the arrows.

Formed on the exterior surface of the net 14 are a plurality of radially oriented arcuate pockets 17 fixedly secured to the exterior surface of the hemispherical shield 13. The pockets 17 are equally spaced about the surface of the shield at 120 degree spacings. Flexible struts 18 are removably positionable within the pockets 17 of the shield 13. The pockets 17 and the associated struts are aligned orthogonally relative to the circular ribs of the cage 12 preventing the netting from entering between the ribs of the cage which would destroy the net 14 upon contact with the blades of the associated fan. FIG. 4 illustrates a modified shield 113 formed of fiberglass net 14 of an equal mesh size of 17 squares per inch. The shield 13 is formed as a rectangular parallelepiped with a perimeter conduit 115 capturing a continuous elastomeric band 116 therewith. The conduit 115 is formed as a rectangular conduit to maintain the geometrical integrity of the shield 113 for securement about the associated fan 11. Elongate linear pockets 117 receive associated flexible struts 118 therewithin which are directed orthogonally relative to the horizontal ribs of the cage 112 of the associated fan 111. The orthogonal orientation of the pockets 117 and the insertable struts 118 again prevent the net 114 from entering between the ribs of the fan 111.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A protective fan shield in combination with a rotary fan including rotating blades, said fan including a cage arranged about the blades and formed of coaxially spaced ribs, said shield comprising, a flexible net member removably mounted about the cage, and stiffening means secured to the net for preventing intrusion of said net between the ribs of a shield, and wherein the stiffening means include a plurality of elongate flexible struts, and wherein the stiffening means further include a plurality of pockets secured to an exterior surface of the net for receiving the struts selectively therewithin, and wherein the shield is of a hemispherical configuration and formed with a continuous conduit about the perimeter thereof with a continuous elastomeric band secured within the conduit, and wherein the net is formed of woven fiberglass to define a mesh of 17 squares per square inch, and wherein the pockets are arcuate in configuration and are arranged orthogonally relative to the ribs of the cage when shield is secured about the cage.

* * * * *